US007782304B2

(12) United States Patent
Kwong et al.

(10) Patent No.: US 7,782,304 B2
(45) Date of Patent: Aug. 24, 2010

(54) SYSTEM AND APPARATUS FOR ADJUSTABLE KEYBOARD ARRANGEMENTS

(75) Inventors: Wah Yiu Kwong, Beaverton, OR (US); Hong W. Wong, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 756 days.

(21) Appl. No.: 11/800,693

(22) Filed: May 7, 2007

(65) Prior Publication Data

US 2008/0041703 A1 Feb. 21, 2008

Related U.S. Application Data

(62) Division of application No. 11/291,332, filed on Nov. 30, 2005, now Pat. No. 7,230,190.

(51) Int. Cl.
*G09G 5/00* (2006.01)

(52) U.S. Cl. ..... 345/168; 345/156

(58) Field of Classification Search ..... 345/156–173; 200/5, 314, 341–345
See application file for complete search history.

(56) References Cited

U.S. PATENT DOCUMENTS

| | | | | |
|---|---|---|---|---|
| 3,818,153 | A | 6/1974 | Arvai | |
| 4,209,682 | A | 6/1980 | Rood | |
| 4,434,338 | A | 2/1984 | Rood | |
| 4,859,820 | A * | 8/1989 | Gotfryd et al. | 200/408 |
| 5,324,902 | A * | 6/1994 | Shen | 200/517 |
| 5,378,862 | A | 1/1995 | Tasaka et al. | |
| 5,430,262 | A | 7/1995 | Matsui et al. | |
| 5,793,311 | A * | 8/1998 | Wood | 341/22 |
| 6,118,234 | A | 9/2000 | Marcellus et al. | |
| 6,466,201 | B1 * | 10/2002 | Koizumi | 345/168 |
| 6,492,602 | B2 | 12/2002 | Asai et al. | |
| 6,773,128 | B2 * | 8/2004 | Katrinecz et al. | 362/84 |
| 6,891,528 | B2 * | 5/2005 | Houston | 345/168 |
| 7,084,787 | B2 * | 8/2006 | Olodort et al. | 341/22 |
| 7,230,190 | B1 * | 6/2007 | Kwong et al. | 200/5 A |
| 7,534,973 | B2 * | 5/2009 | Voelckers | 200/5 R |
| 2003/0169232 | A1 * | 9/2003 | Ito | 345/156 |
| 2003/0173201 | A1 * | 9/2003 | Ohashi | 200/517 |
| 2006/0196759 | A1 | 9/2006 | Soumi | |

* cited by examiner

*Primary Examiner*—Nitin Patel
(74) *Attorney, Agent, or Firm*—Blakely, Sokoloff, Taylor & Zafman LLP

(57) ABSTRACT

Some embodiments of the invention include an apparatus and system for keyboard arrangements where one or more of the keys are adjustable. In some embodiments, the arrangement includes one or more keys and a moving mechanism for controlling the position of the keys. The keys may be adjusted in terms of height. The adjustment in height may result from the operation of a lever or switch, or as a result of opening the case or shell of the system. Other embodiments are described.

17 Claims, 6 Drawing Sheets

700

SYSTEM AND APPARATUS FOR ADJUSTABLE KEYBOARD ARRANGEMENTS

RELATED PATENT APPLICATION

This application is a divisional of the U.S. patent application Ser. No. 11/291,332, filed on Nov. 30, 2005, now U.S. Pat. No. 7,230,190 entitled "System and Apparatus for Adjustable Keyboard Arrangements."

BACKGROUND

1. Technical Field

Some embodiments of the invention generally relate to keyboards. More particularly, some embodiments of the invention relate to keyboard attached to a personal computer (PC), a personal digital assistant (PDA), and other apparatuses.

2. Discussion

As the trend toward smaller, thinner, and lighter electronic devices continues, small and low-profile keyboards convenient for portability have been increasingly demanded by users. In addition, user demands have also included the need to reduce the drawbacks of low-profile keyboards. These drawbacks include, among other things, reducing the thickness of the keyboard (especially in notebook computers and other mobile devices) resulted in loss of tactile feel and reduced key travel distance.

Thus, there is a need to maintain the precision and operability of a keyboard, such as maintaining the length/depth of a keystroke, and maintaining tactile response, at the same time minimize the overall keyboard thickness.

BRIEF DESCRIPTION OF THE DRAWINGS

Various advantages of embodiments of the present invention will become apparent to one skilled in the art by reading the following specification and appended claims, and by referencing the following drawings, in which:

DETAILED DESCRIPTION

In some embodiments of the invention, the amount of space, which may be referred to as thickness, required for a keyboard to maintain preferred tactile feel (force, key stroke and travel distance) is typically about 3-7 millimeters (mm). Variations in thickness may be limited by performance issues for the keyboard, such as, but not limited to, the aforementioned tactile feel and key travel distance. According to some embodiments of the invention, the keyboard thickness may be reduced to less than 3 mm, yet maintain the tactile feel and key travel distance of a thicker keyboard.

In some embodiments of the invention, the reduced thickness may increase the usable internal volume of any system of which the keyboard is a component, such as a laptop PC. The increased volume may be useful for making the system thinner, as well as for adding any of a number of other features or components, such as, but not limited to, a thermal solution or memory, etc.

Many specific features of the one or more embodiments of the invention are discussed herein using various terms, such as, but not limited to, spring, keyboard, and key. These terms are well understood in their relevant art(s); and one of ordinary skill in the relevant art(s) would appreciate that their usage does not limit the embodiments of the invention to a specific or strict implementation of the term.

Referring now to FIGS. 1-6, descriptions of some embodiments of the invention are given of a keyboard arrangement with a moving mechanism, and a system with a keyboard.

Figure 1:
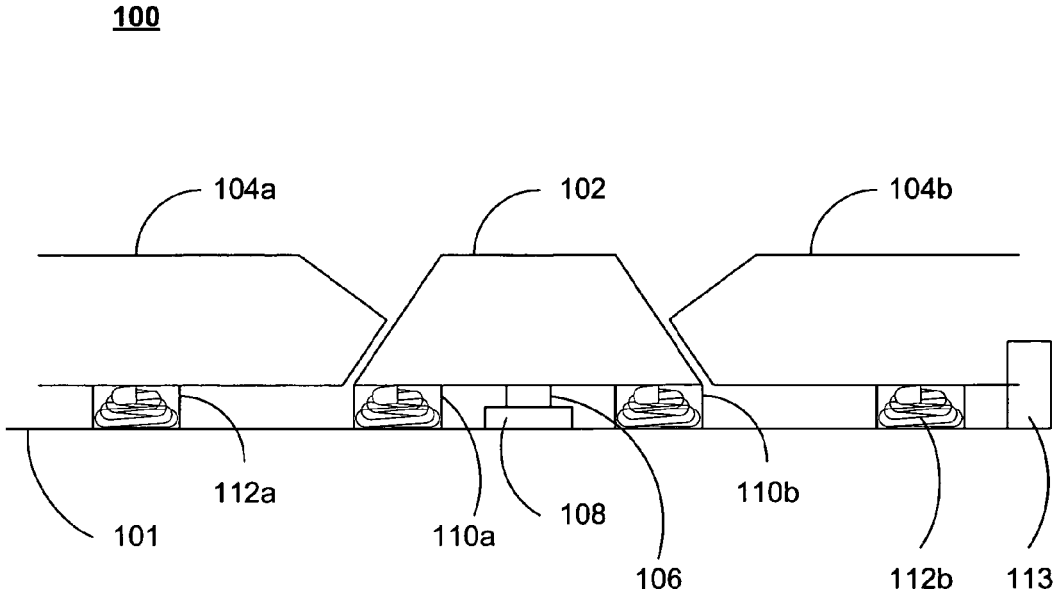
FIG. 1 is a schematic view of an adjustable keyboard arrangement with a moving mechanism in a lowered or compressed position according to some embodiments of the invention.

FIG. 1 includes a schematic view of an adjustable keyboard arrangement 100 with a holding member 104 in a lowered position in close proximity or flush with base 101, according to some embodiments of the invention. The moving mechanism includes the holding member 104 and a support member 112, according to some embodiments of the invention. Optionally, in some embodiments of the invention, the moving mechanism 104 may include a control lever 113 to hold the moving mechanism in place. In some embodiments, the holding function may be integrated into the support member 112 or may be a function of the design of the keyboard or system.

The arrangement 100 also includes a key 102 of a keyboard. The key 102 operates through the depression of the key 102 so that contact 106 activates a switch 108. The operation of the key 102, indeed of all of the keys described herein, according to some embodiments of the invention, may be described as such: The switch 108 may be made of a conductor, such as metal or a substrate, and connected electrically to the base 101. Although some embodiments of the invention indicate the switch 108 is just below the contact 106, the position of the switch 108 is not limited as long as the switch 108 may contact the contact 106 when the key 102 is depressed. In some embodiments, when the contact 106 contacts the switch 108, the depression of the key may be recognized or otherwise information input may be recognized. The switch 108 and contact 106 may use any structure known in the art, as one of ordinary skill would appreciate based at least on the teachings described herein.

One or more mechanical springs 110, shown as 110*a*-110*b*, may provide an elastic response to the depression of the key 102 and provide a push to restore the key 102 to its original position. The mechanical spring can be replaced with an elastic dome-like structure than can provide the elastic response. In some embodiments of the invention, the elastic dome-like structure may be constructed or molded of rubber, or an equivalently elastic material. The position of the key 102 is determined by the holding member 104, such as, but not limited to, 104*a*-104*b*. The holding member 104 arrests the position of the key 102 at a height above the base 101. The height may be determined by the control lever 113 (or by the one shown in FIG. 5) or predetermined by the design of the arrangement 100.

The position of the holding member 104 may be raised, lowered, or maintained by one or more support members 112, such as, but not limited to, support members 112*a*-112*b*, according to some embodiments of the invention. The support members 104, as well as those of other embodiments described in the other figures, may be an elastic, stressed, stored-energy machine element that when released, will recover its basic form or relative position. Examples of support members, according to some embodiments of the present invention, include a clip, a coil, a sponge, an elastic dome-like structure and magnets (when oriented or structured properly). In some optional embodiments of the invention, this feature may be performed by the control lever 113.

Furthermore, a keyboard may include one or more keys which, according to some embodiments of the invention, are control levers, input means, actuators, switches, or other arrangement to operate a machine. As such, a keyboard may be a hardware unit with a set of switches that resembles a typewriter keyboard and that conveys information from a user to a machine or system or to a data communications circuit, such as, but not limited to a serial, parallel, or universal serial bus (USB).

In some embodiments of the invention, there is little or no space between the components 102 and 104. In all of the figures there may be some separation and exposition of the components to aid the reader's comprehension, as one of ordinary skill in the relevant art would appreciate based at least on the teachings described herein.

Figure 2:
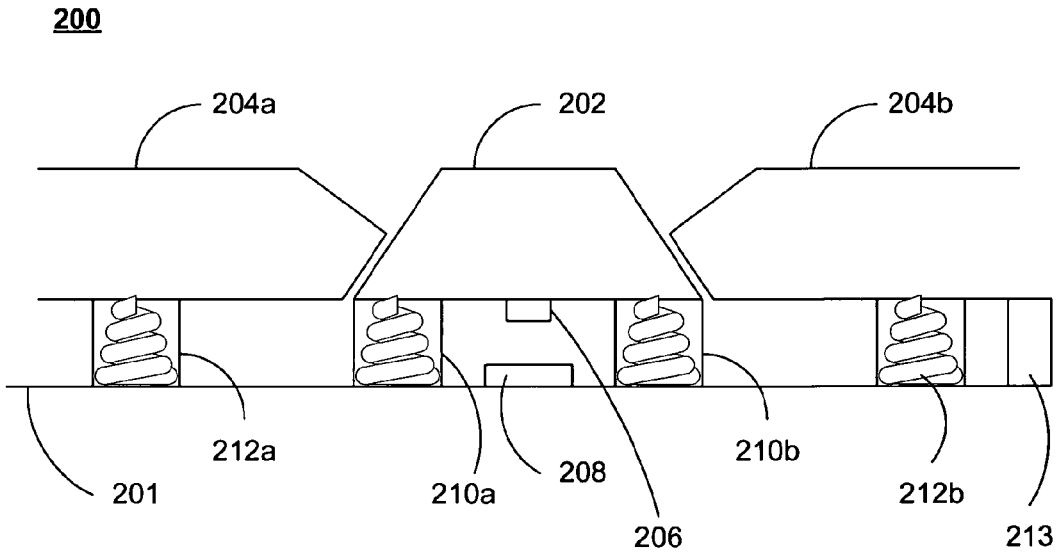
FIG. 2 is a schematic view of an adjustable keyboard arrangement with a moving mechanism in an extended position according to some embodiments of the invention.

FIG. 2 includes a schematic view of an adjustable key arrangement 200 with a holding member 204 in an extended position extended away from a base 201, according to some embodiments of the invention. The moving mechanism includes the holding member 204 and a support member 212, according to some embodiments of the invention. Optionally, in some embodiments of the invention, the moving mechanism 204 may include a control lever 213 to hold the moving mechanism in place. In some embodiments, the holding function may be integrated into the support member 212 or may be a function of the design of the keyboard or system.

The arrangement 200 also includes a key 202 of a keyboard. The key 202 operates through the depression of the key 202 so that contact 206 activates a switch 208. One or more mechanical springs 210, shown as 210*a*-210*b*, may provide an elastic response to the depression of the key 202 and provide a push to restore the key 202 to its original position. The position of the key 202 is determined by the holding member 204, such as, but not limited to, 204*a*-204*b*. The holding member 204 arrests the position of the key 202 at a height above the base 201. The height may be determined by a control lever 213 (or by the one shown in FIG. 5) or predetermined by the design of the arrangement 200.

The position of the holding member may be raised, lowered, or maintained by one or more support members 212, such as, but not limited to, support members 212*a*-212*b*, according to some embodiments of the invention.

Figure 3:
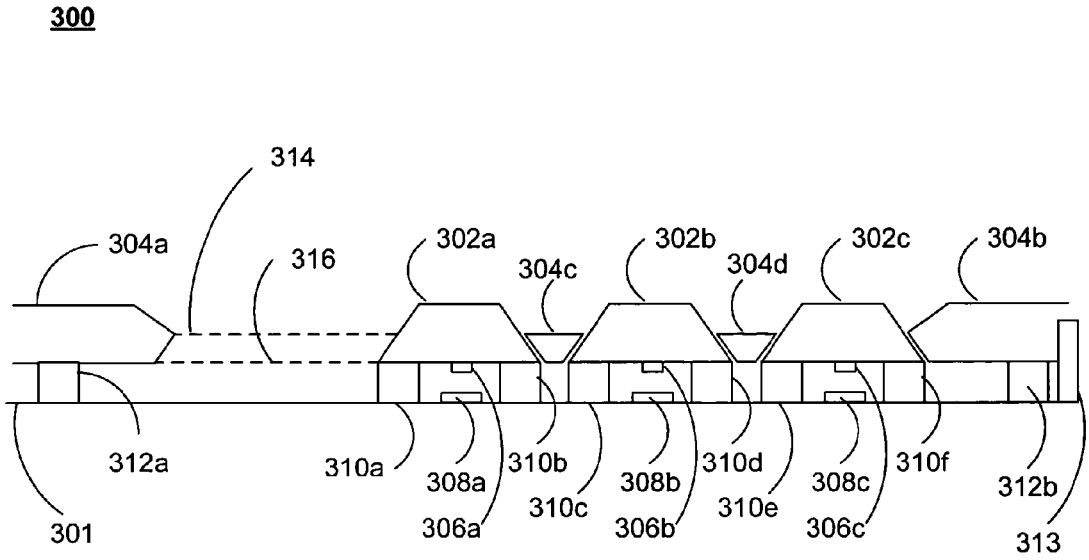
FIG. 3 is a schematic view of an adjustable keyboard arrangement according to some embodiments of the invention.

FIG. 3 includes a schematic view of an adjustable keyboard arrangement 300 with multiple keys 302 and an alternative holding member 304 according to some embodiments of the invention. The moving mechanism includes the holding member 104 and a support member 112, according to some embodiments of the invention. Optionally, in some embodiments of the invention, the moving mechanism 304 may include a control lever 313 to hold the moving mechanism in place. In some embodiments, the holding function may be integrated into the support member 312 or may be a function of the design of the keyboard or system.

The arrangement 300 also includes a plurality of keys 302. The keys 302 operate through the depression of each of the keys 302 so that contact 306 activates a switch 308. One or more mechanical springs 310, shown as 310*a*-310*f*, may provide an elastic response to the depression of each of the keys 302 and provide a push to restore the key 302 to its original position. The position of the key 302 is determined by the holding member 304, such as, but not limited to, 304*a*-204*d*. The holding member 304 arrests the position of each of the keys 302 at a height above the base 301. The height may be determined by a control lever 313 (or by the one shown in FIG. 5) or predetermined by the design of the arrangement 300.

Figure 5:
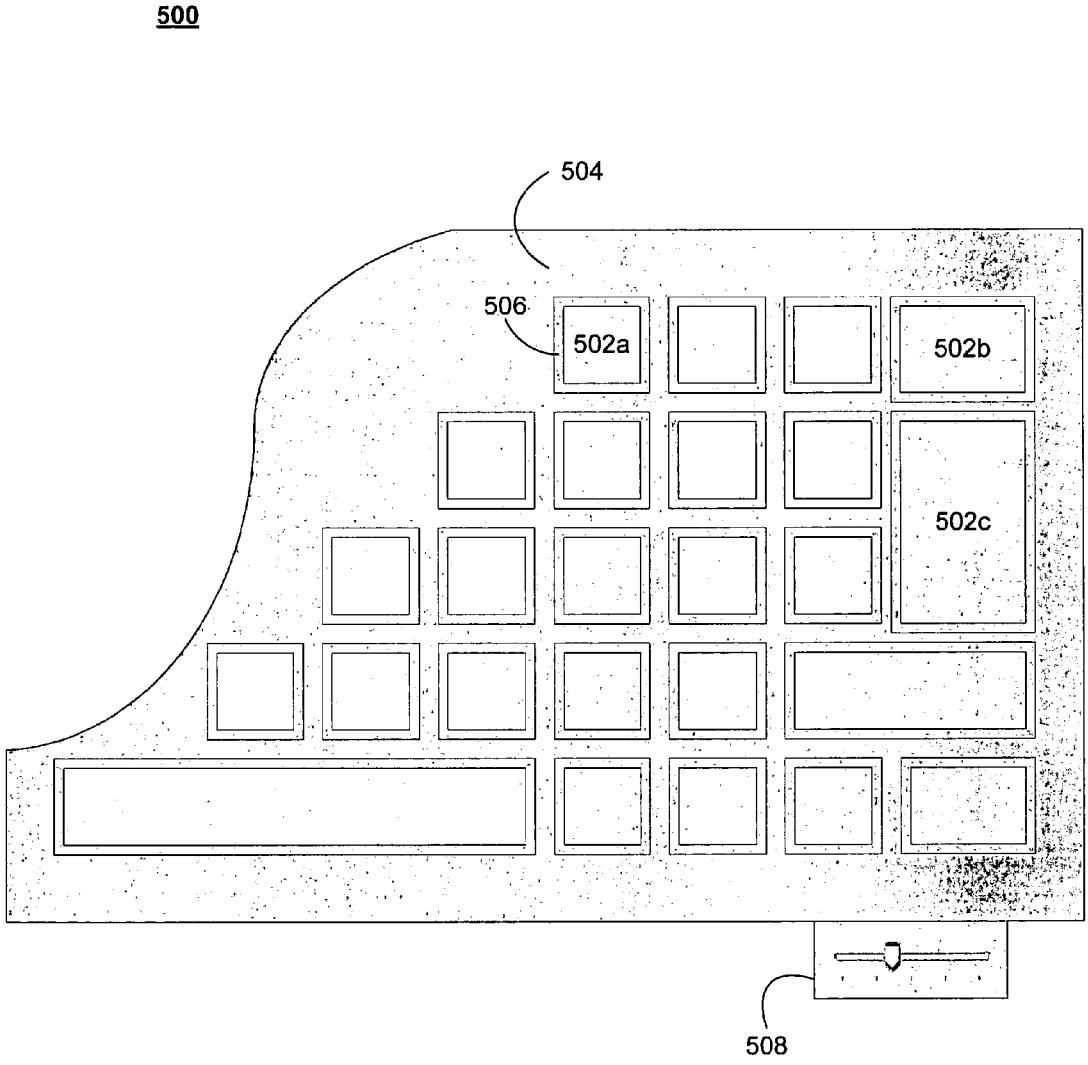
FIG. 5 is a overhead view of an adjustable keyboard arrangement according to some embodiments of the invention.

The position of the holding member may be raised, lowered, or maintained by one or more support members 312, such as, but not limited to, support members 312*a*-312*b*, according to some embodiments of the invention. The holding member may enclose all of the plurality of keys, as shown in FIG. 5, both in accord with some embodiments of the invention, and elements 314 and 316 show an extrusion of the holding member 304. In some embodiments of the invention, the holding member 304 may also include between key components, such as 304*c* and 304*d*. The components may be coupled to the components 304*a* and 304*b*, as part of a larger structure, according to some embodiments of the invention.

Figure 4:
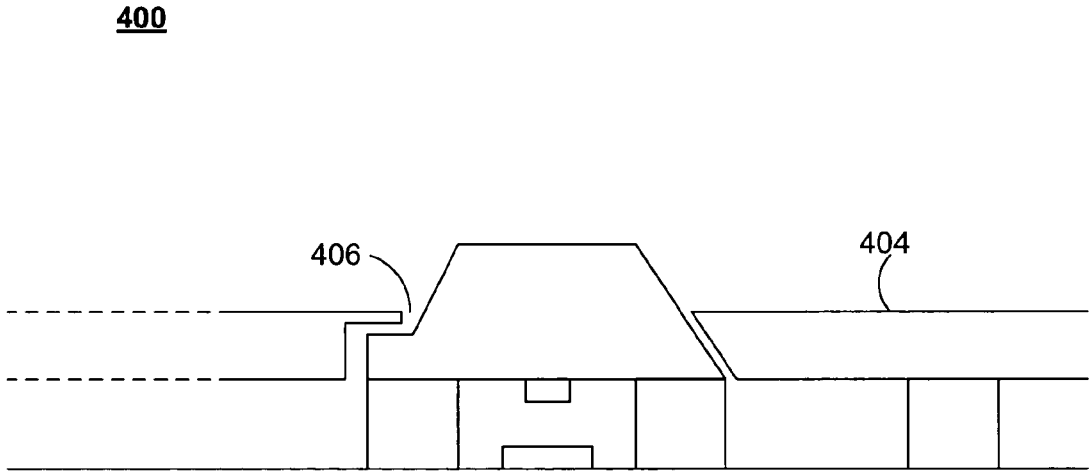
FIG. 4 is a schematic view of an adjustable keyboard arrangement with an alternative moving mechanism according to some embodiments of the invention.

FIG. 4 is a schematic view of an adjustable key arrangement 400 with an alternative holding member 404, according to some embodiments of the invention. The holding member 404 is of a different shape than those previously illustrated, yet it may still, according to embodiments of the invention, operate in the same manner as those holding members previously described. Furthermore, in some embodiments, one or both of the key or holding member may include a protruding feature, such as, but not limited to those shown at 406 in FIG. 4.

FIG. 5 includes a overhead view of an adjustable keyboard arrangement 500 according to some embodiments of the invention. The arrangement 500 may include a plurality of keys 502, such as, but not limited to, keys 502*a*-502*c*. In some embodiments of the invention, the keys 502 include sloped surfaces or protruding feature 506. The feature 506 may be in contact with the moving mechanism 504, in some embodiments of the invention; and may include a control lever 508. The control level 508 may allow for the selection of the height (distance from the base) of the moving mechanism 504 and therefore the keys 502.

In some embodiments of the invention, the keys 502 may be of different sizes, as shown in FIG. 5. Furthermore, the keys 502 may be of different distances from each other, as shown by keys 502*b* and 502*c*. In some embodiments, the features 506 may be of different slopes or protrusion, and one of ordinary skill in the relevant art would appreciate how to match the features to allow for the operation of the embodiments of the invention by adjusting the height of the keys of a keyboard by the use of a moving mechanism. In some embodiments of the invention, the moving mechanism may be removable. In some other embodiments of the invention, the holding member may be removable and the supporting members may remain coupled to the base.

Furthermore, in some embodiments, the holding member and the key each include oppositely aligned slopes with which to contact one another to adjust the height of the key. In some embodiments, the holding member and the key each include a protruding feature with which to contact one another to adjust the height of the key.

According to some embodiments of the invention, the moving mechanism moves a range of flush with the base to 10 millimeters above the base. In other embodiments, the moving mechanism may have a substantially greater range or operate in stages of more than one moving mechanism. Also, in some embodiments, the support member is attached to the base and/or the holding member.

The various components of the embodiments of the invention may be constructed of metal, plastic, resin, foam, or other suitable material, and may be molded, cut, or pressed into their various structures, as one of ordinary skill in the relevant arts would appreciate based at least on the teachings described herein. Furthermore, the degree of stiffness, flexibility, or the ability to fold, compress, or be stretched is also well understood by one of ordinary skill in the relevant art, and as such, the combination of various materials in a component may be implemented to at least allow a component to perform as described herein, and also to provide for varying embodiments of keyboards, e.g., folding or flexible keyboards, or the implementation of the invention on a hand-held calculator or push-button telephone.

Figure 6:
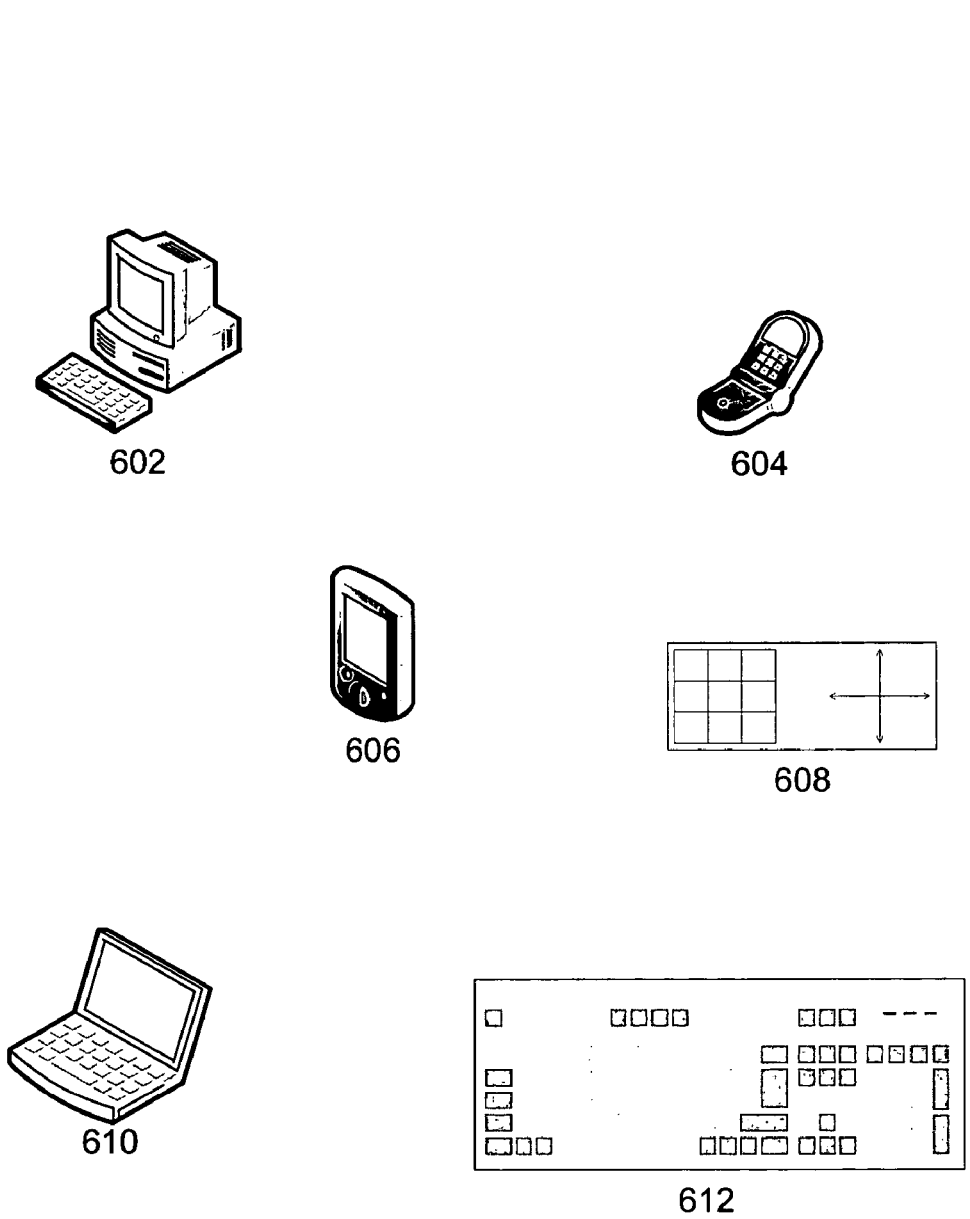
FIG. 6 includes some example views of systems and apparatuses, each with an adjustable keyboard arrangement, according to some embodiments of the invention.

FIG. 6 includes some example views of systems and apparatuses, each with an adjustable keyboard arrangement, according to some embodiments of the invention. The systems 600 may include a PC 602, a cellular or wireless telephone 604, a PDA 606, a remote control or universal remote control 608, a notebook or laptop computer system 610, and a keyboard 612. One or ordinary skill in the relevant arts would appreciate based at least on the teachings described herein, that there may be any different type of mobile electronic system such as a mobile device or a non-mobile system such as a server or enterprise computing system. Other types of electronic systems are also within the scope of various embodiments of the invention.

As one of ordinary skill in the relevant art would appreciate, based at least on the teachings described herein, a computer system, such as the systems 600, may include a display for presenting information, such as, but not limited to, a liquid crystal display (LCD), a processor to process information and numerous other components, such as, but not limited to: a hard drive, a network interface card (NIC), a wireless network interface card, a mouse, trackball, trackpad, stylus, or cursor direction keys.

Furthermore, according to some embodiments of the invention, the components of the system and apparatus may be coupled directly or indirectly to each other. As one of ordinary skill in the relevant art would appreciate, based at least on the teachings provided herein, the use of the term 'coupled' means either directly or indirectly, for example, one or more data communication interfaces, circuits, chips, and/or buses may reside between the two components, yet they remain coupled.

It will be appreciated by one of ordinary skill in the relevant art, based at least on the teachings provided herein, that the systems 600 and/or other systems of various embodiments may include other components or elements not shown in FIG. 6 and/or not all of the elements shown in FIG. 6 may be present in systems of all embodiments.

While many specifics of one or more embodiments have been described above, it will be appreciated that other approaches for adjusting the keyboard arrangement may be implemented for other embodiments. For example, while layouts are mentioned above, for other embodiments, other layouts and/or other keyboard arrangements may implement some embodiments of the invention.

Figure 7:
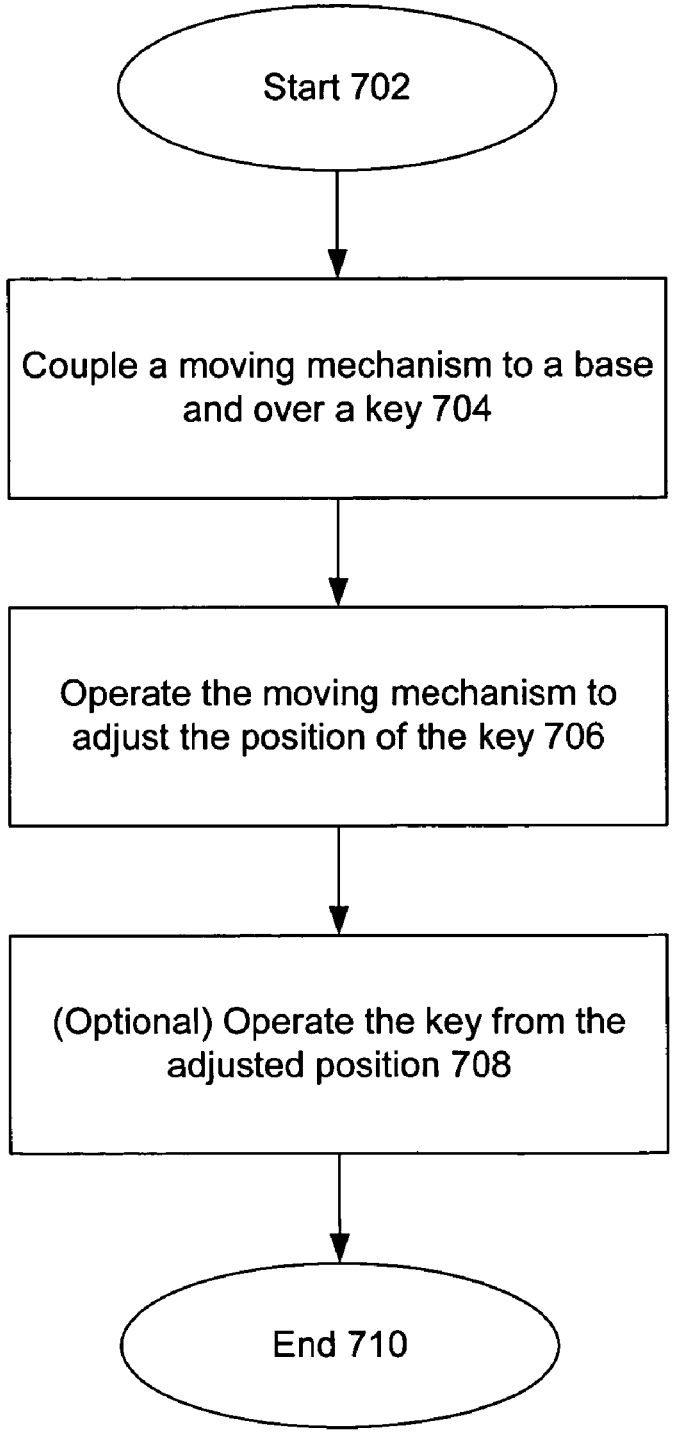
FIG. 7 includes some operations of an adjustable keyboard arrangement in a flowchart according to some embodiments of the invention.

Furthermore, FIG. 7 includes some operations of an adjustable keyboard arrangement in a flowchart according to some embodiments of the invention. The operations begin at 702 and proceed to 704, where the operation couples a moving mechanism onto a base. In some embodiments of the invention, the moving mechanism is placed over a key. The operations then proceed to 706, where the moving mechanism is adjusted a position of the key. In some embodiments of the invention, the position may be over the key or generally in proximity to the key. In alternative embodiments of the invention, the moving mechanism may be substantially on the same level as the key, with openings, such as those shown in the figures, which allow the keys to go through the moving mechanism to a certain degree.

In some embodiments of the invention, the operation may proceed to 708, where the key is operated from the position of adjustment.

Any reference in this specification to "one embodiment," "an embodiment," "some embodiments," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Embodiments of the invention are described in sufficient detail to enable those skilled in the art to practice the invention. Other embodiments may be utilized, and structural, logical, and intellectual changes may be made without departing from the scope of the present invention. Moreover, it is to be understood that various embodiments of the invention, although different, are not necessarily mutually exclusive. For example, a particular feature, structure, or characteristic described in one embodiment may be included within other embodiments. Accordingly, the detailed description is not to be taken in a limiting sense.

The foregoing embodiments and advantages are merely exemplary and are not to be construed as limiting the present invention. For instance, the present teaching can be readily applied to other types of input devices. Those skilled in the art can appreciate from the foregoing description that the techniques of the embodiments of the invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A system comprising:

a keyboard to convey information, wherein the keyboard includes a key coupled to a base by a spring, wherein the key includes a contact to activate a switch at the base, and a moving mechanism that moves the key in a substantially vertical direction and maintains the position of the key with respect to the moving mechanism, wherein the moving mechanism includes a holding member coupled to a support member, wherein the support member is further coupled to the base;

a processor coupled to the keyboard to received information from the keyboard; and a display coupled to the processor to display other information received from the processor.

2. The system of claim 1, wherein the keyboard further includes a control lever to select a height of the moving mechanism in a substantially vertical direction from the base.

3. The system of claim 2, wherein the control lever maintains the height of the moving mechanism.

4. The system of claim 1, wherein the keyboard further includes a plurality of keys attached to the base, wherein each key of the plurality of keys is moved by the moving mechanism.

5. The system of claim 1, wherein at least the holding member is removable.

6. The system of claim 1, wherein the support member includes one of a coil, a clip, a sponge, an elastic dome-like structure or a magnet.

7. The system of claim 1, wherein the holding member and the key each include oppositely aligned slopes with which to contact one another to adjust the height of the key.

8. The system of claim 1, wherein the holding member and the key each include a protruding feature with which to contact one another to adjust the height of the key.

9. The system of claim 1, wherein the moving mechanism moves a range of flush with the base to 10 millimeters above the base.

10. The system of claim 1, wherein the support member is attached to the base and/or the holding member.

11. A method comprising:

coupling a moving mechanism onto a base, wherein the moving mechanism is placed over a key; and operating the moving mechanism to adjust a position of the key.

12. The method of claim 11, further comprising:

operating the key from the position of adjustment.

13. The method of claim 11, wherein the moving mechanism includes a holding member coupled to a support member, wherein the support member is further coupled to the base.

14. The method of claim 11, wherein the operation of the moving mechanism is selectable at more than one position.

15. The method of claim 11, wherein the position refers to movement in a substantially vertical direction.

16. The method of claim 11, wherein the moving mechanism is removable.

17. The method of claim 11, wherein the key is one of a plurality of keys over which the moving mechanism is placed.

* * * * *